US007524086B1

(12) United States Patent
Saieva

(10) Patent No.: US 7,524,086 B1
(45) Date of Patent: Apr. 28, 2009

(54) HIGH INTENSITY DISCHARGE (HID) LAMP WITH INTEGRAL BALLAST AND UNDERWATER LIGHTING SYSTEMS INCORPORATING SAME

(75) Inventor: Carl Saieva, Port Jefferson, NY (US)

(73) Assignee: Sartek, LLC, Medford, NY (US)

( * ) Notice: Subject to any disclaimer, the term of this patent is extended or adjusted under 35 U.S.C. 154(b) by 5 days.

(21) Appl. No.: 11/923,838

(22) Filed: Oct. 25, 2007

Related U.S. Application Data

(63) Continuation of application No. 10/745,139, filed on Dec. 23, 2003, now Pat. No. 7,314,290, which is a continuation of application No. 09/783,767, filed on Feb. 15, 2001, now Pat. No. 6,679,619.

(60) Provisional application No. 60/183,767, filed on Feb. 18, 2000.

(51) Int. Cl.
*F21V 29/00* (2006.01)

(52) U.S. Cl. ..... 362/264; 362/287; 362/373

(58) Field of Classification Search ..... 362/264, 362/263, 261, 267, 158, 22, 294, 373, 547; 315/185 S, 200 A, 56–59; 313/492, 238
See application file for complete search history.

(56) References Cited

U.S. PATENT DOCUMENTS

| | | | |
|---|---|---|---|
| 3,229,084 | A | 1/1966 | Bates |
| 3,234,421 | A | 2/1966 | Reiling |
| 3,652,846 | A | 3/1972 | Starck, II |
| 3,852,587 | A | 12/1974 | Koehler |
| 3,965,287 | A | 6/1976 | Mueller |
| 4,281,274 | A | 7/1981 | Bechard et al. |
| 4,490,649 | A | 12/1984 | Wang |
| 4,920,459 | A | 4/1990 | Rothwell, Jr. et al. |
| 4,947,304 | A | 8/1990 | Payne et al. |
| 5,036,444 | A | 7/1991 | Hiles |
| 5,072,347 | A | 12/1991 | Brunson |
| 5,089,945 | A | 2/1992 | Mula |
| 5,105,346 | A | 4/1992 | Acks et al. |
| 5,144,201 | A | 9/1992 | Graham et al. |
| 5,381,076 | A | 1/1995 | Nerone |
| 5,381,322 | A | 1/1995 | Humphreys |

(Continued)

OTHER PUBLICATIONS

Welch Allen News, Read This; 14 messages posted from Oct. 8, 2004 thru Oct. 16, 2004 to this thread on an online forum at thedecostop.com > Dive Equipment Forums > Lights.

(Continued)

*Primary Examiner*—Bao Q Truong
(74) *Attorney, Agent, or Firm*—Taft, Stettinius & Hollister LLP

(57) ABSTRACT

A lighting system has a power source and a light head including a high intensity discharge lamp. The lamp is supported by a support base on a sealed electronics container that includes walls defining a space within which an electronic ballast is enclosed in proximity to the lamp to insure reliable ignition. A cover surrounding the lamp and sealed to the support base includes a portion allowing light to project outwardly from the light head. Thermally conductive material surrounds and contacts the electronic ballast and also the interior of the walls of the container so that the container extracts heat away from the ballast to the walls of the container.

18 Claims, 5 Drawing Sheets

U.S. PATENT DOCUMENTS

| | | | |
|---|---|---|---|
| 5,412,549 | A | 5/1995 | Blakely |
| 5,416,676 | A | 5/1995 | Carpenter |
| 5,493,484 | A | 2/1996 | Osteen et al. |
| 5,548,497 | A | 8/1996 | Cho |
| 5,604,406 | A | 2/1997 | Gaus |
| 5,860,730 | A | 1/1999 | Hesperich |
| 5,879,073 | A | 3/1999 | Hori et al. |
| 6,000,819 | A | 12/1999 | Graber et al. |
| 6,004,008 | A | 12/1999 | Lai |
| 6,174,074 | B1 | 1/2001 | Lahijani |
| 6,175,487 | B1 | 1/2001 | McCartney et al. |
| 6,467,930 | B1 | 10/2002 | Frick |
| 6,679,619 | B2 | 1/2004 | Saieva |
| 6,702,452 | B2 | 3/2004 | Jigamian et al. |
| 6,796,688 | B2 | 9/2004 | Huang |
| 2003/0179577 | A1 | 9/2003 | Marsh |

OTHER PUBLICATIONS

AUL contact; 7 messages posted from Jan. 29, 2004 thru Jan. 31, 2004 to this thread on an online forum at thedecostop.com > Dive Equipment Forums > Lights.

NiMH canister with 10 watt HID lighthead . . . ; 31 messages posted from Feb. 15, 2003 thru Mar. 21, 2003 to a thread which started with this title on an online forum at www.scubaboard.com > The Equipment of Scuba Diving > Accessories > Lights.

Sartek Adjustable; 4 messages posted from Apr. 9, 2003 thru Apr. 11, 2003 to a thread which started with this title on an online forum at www. scubaboard.com > Lights.

HID Light experiences . . . ; 27 messages posted from Aug. 10, 2001 thru Aug. 23, 2001 to a thread which started with this title on an online forum at www. scubaboard.com > Lights.

AUL vs. Halcyon lights; 21 messages posted from Jul. 14, 2002 thru May 26, 2003 to a thread which started with this title on an online forum at www. scubaboard.com > Lights.

Lights for cave diving?; 17 messages posted from May 23, 2002 thru Nov. 5, 2002 to a thread which started with this title on an online forum at www. scubaboard.com > The Art of Scuba diving > Tek Talk > Cave Diving.

Re: MAL-LIGHTING; Messages posted from Mar. 22, 2004 thru Apr. 7, 2004 to a thread which started with this title on an online forum entitled hiddivelights at groups.yahoo.com.

Anyone familiar with Hawes Lights?; 9 messages posted from Nov. 30, 2003 thru Dec. 28, 2003 to a thread which started with this title on an online forum at www. scubaboard.com > Lights.

Alan Uke; Letter to Mr. David Greer re: *Sartek LLC* vs. *Underwater Kinetics;* Apr. 2, 2004.

Mark Olsson; Email to James H. Greer; Subject: Sartek LLC : HID + Ballast Patent, with attachment: MaxaBeam brochure and price list; Apr. 5, 2004.

Mark Olsson; Email to James H. Greer; Subject: Sartek LLC : HID + Ballast Patent >> LMI info, with attachment: Light & Motion Industries, Inc. 1998 Catalog & Selection Guide; Apr. 5, 2004.

Mark Olsson; Email to James H. Greer; Subject: Sartek LLC : HID + Ballast Patent >> German info, with attachment: letter from Christian Auerswald to Deep Sea Power and Light; Apr. 5, 2004.

Mark Olsson; Email to James H. Greer; Subject: FW: Stupid US Patent . . . , with attachment: Treble-Light materials; Apr. 5, 2004.

Mark Olsson; Email to James H. Greer; Subject: Sartek, with attachments: Assembly Spec from Light & Motion Industries and materials re: Treble-Light Diving Lamps; Apr. 5, 2004.

Mark S. Olsson; Letter to Carl J. Saieva; Apr. 12, 2004.

David C. Greer; Letter to Mark S. Olsson; RE: *Sartek LLC, et al.* v. *Lamartek, Inc. d/b/a/ Dive-Rite, et al.* Case No. 3:04 CV 0098 United States District Court for the Southern District of Ohio; Apr. 12, 2004.

Mark S. Olsson; Letter to David C. Greer; RE: *Sartek LLC, et al.* v. *Lamartek, Inc. d/b/a/ Dive-Rite, et al.* Case No. 3:04 CV 0098 United States District Court for the Southern District of Ohio; Apr. 17, 2004.

David C. Greer; Letter to Alan K. Uke, Statutory Agent; RE: *Sartek LLC, et al.* v. *Lamartek, Inc. d/b/a/ Dive-Rite, et al.* Case No. 3:04 CV 0098 United States District Court for the Southern District of Ohio; Apr. 19, 2004.

Marc Allsman: Letter to David H. Greer, ESQ.; RE: Sartek LLC Case No. 3:04 CV 0098; Apr. 22, 2004.

Arnold T. Jackson, Jr.; Letter to David C. Greer; RE: Sartek LLC Case 3:04 CV0098; Apr. 23, 2004.

David C. Greer; Letter to Arnold T. Jackson, Jr., Statutory Agent; RE: *Sartek LLC, et al.* v. *Lamartek, Inc. d/b/a Dive-Rite, et al.* United States District Court for the Southern District of Ohio Case No. 3:04 CV 0098: Apr. 30, 2004.

John S. Ferrell; Letter To David C. Greer, Esq.; RE: *Sartkek LLC et al.* v. *Lamartek, Inc. d/b/a Dive-Rite, et al.* Case No. 3:04CV0098—United States District Court, Southern District of Ohio; May 7, 2004.

David C. Greer; Letter to John S. Ferrell, Esq.; RE: *Sartek LLC, et al.* v. *Lamartek, Inc. d/b/a Dive-Rite, et al.* Case No. 3:04 CV 0098—United States District Court, Southern District of Ohio Your Client: Light & Motion Industries, Inc.; May 18, 2004.

Richard J. Warburg; Letter to James Greer, David Greer; Re: *Sartek LLC* v. *Underwater Kinetics, Inc. et al.;* Jun. 4, 2004.

What about them lawsuits . . . ; 45 messages posted from Apr. 5, 2004 thru Apr. 19, 2004 to a thread which started with this title on an online forum at www.scubaboard.com > Lights.

Re: [hiddivelights] Re: Sartek HID Patent; 3 messages posted on Apr. 6, 2004 to a thread with this title on an online forum entitled hiddivelights at groups.yahoo.com.

What happened to AUL?; 16 messages posted from Apr. 5, 2004 thru Apr. 6, 2004 to a thread with this title on an online forum, at www. scubaboard.com > Lights.

Sartek get the patent for al dive HID lights in the USA; message posted Jul. 22, 2004 to online forum at diving-in-norway.com.

Mark Olsson; Email to James H. Greer; Subject: More Prior Art > Blackbirn, with attachment: Magnetic Particle Inspection Products brochure; Apr. 5, 2004.

"NiMH-HID Technical," 1996 ("SunRay A") (collectively a part of the "SunRay References").

"Specification and Bill of Materials for SunRay HID," 1997 ("SunRay B") (collectively a part of the "SunRay References").

"Procedure for SunRay HID Ballast/Body Assembly," 1996 ("SunRay C") (collectively a part of the "SunRay References").

"Procedure for SunRay HID Gunking Assembly," 1996 ("SunRay D") (collectively a part of the "SunRay References").

"1998 Catalog & Selection Guide" (Part of "SunRay E") (collectively a part of the "SunRay References").

DiveTraining Magazine, Jul. 1997 (Part of "SunRay E") (collectively a part of the "SunRay References").

Oceans 82 Conference Record, "A Xenon Arc Light for the Johnson-Sea-Link Submersible," Washington, D.C., Sep. 20-22, 1982, pp. 349-354.

U.S. District Court for the Southern District of Ohio (3:04-CV-00098-WHR), *Sartek L.L.C., et al.* v. *Lamartek, Inc. et al.,* Transcript of Proceedings (Oct. 14, 2004).

Advanced Diver Magazine, Fall 1999, Issue 3, p. 12-13.

Sartek Industries Inc., Have You Seen "The Light"? Advertisement (published Feb. 18, 2000 or earlier).

Sartek Industries Inc., HID-18R & HID18RW High Intensity Discharge Arc Light (published Feb. 18, 2000 or earlier).

Advance Transformer Co., "Pocket Guide to High Intensity Discharge Lamp Ballasts," U.S.A., 1998.

Intervention Conference and Exposition 1989, "ROV Lighting with Metal Halide," San Diego, California, Mar. 1989, pp. 182-189.

Welch Allyn, Solarc Lamp Products, "Operation and Installation Manual," U.S.A., 1997.

Blackbirn Oceanographics "Blackbirn," Los Angeles, California, 1981.

File Wrapper of U.S. Appl. No. 60/183,767, Feb. 18, 2000.

HIGH INTENSITY DISCHARGE (HID) LAMP WITH INTEGRAL BALLAST AND UNDERWATER LIGHTING SYSTEMS INCORPORATING SAME

This continuation application claims the benefit under 35 U.S.C. §120 of non-provisional application Ser. No. 10/745,139 filed Dec. 23, 2003 (the '139 application has been allowed and the issue fee paid) which claims the benefit under 35 U.S.C. §120 of non-provisional application Ser. No. 09/783,767 filed Feb. 15, 2001, now U.S. Pat. No. 6,679,619 (currently under inter partes reexamination—see Inter Partes Reexamination Control No. 95/000,060), which claims the benefit of provisional application Ser. No. 60/183,767, filed Feb. 18, 2000, the complete disclosures of which are incorporated by reference herein.

BACKGROUND OF THE INVENTION

1. Field of the Invention

The invention relates to lamps and lighting systems and, more particularly, to an HID lamp with integral ballast and lighting systems incorporating the same. While the present invention will be described with reference to underwater diving light systems for which it was originally developed, it is to be understood that it can be used for other lighting applications both in and out of water.

2. Brief Description of the Prior Art

Underwater exploration, or exploration in other low ambient light environments, is virtually impossible without the aid of some type of artificial lighting system. Even under broad daylight, when diving beyond a certain depth, the natural light from the sun is severely affected by the water. In addition to loss of light intensity, water produces spectral changes in the light to the extent that color is not readily recognizable and the view underwater appears to be only bluish black and white. Moreover, even at relatively shallow depths, artificial lighting is necessary to see objects in shadows or in crevices. Exploration of caves, shipwrecks, or comparable very dark or harsh environments, is impossible without bright artificial lighting systems.

The simplest lighting systems utilize ordinary incandescent lamps powered by rechargeable batteries. Ordinary incandescent lamps are inefficient and produce a limited spectrum which is unsuitable for photography, particularly under water. Halogen lamps provide a much higher intensity than ordinary incandescent lamps and also provide a balanced spectrum which can be used with certain types of film to capture colors accurately in difficult lighting conditions, such as underwater. For example, many halogen lamps are balanced to a color temperature of 3200° K, and some film emulsions are designed to be used with illumination within this spectrum. Filters are also available for use with daylight (6500° K) balanced emulsions and 3200° K light sources.

Although the halogen lamps are an improvement over ordinary incandescent lamps, they share some of the disadvantages of ordinary incandescent lamps and have some disadvantages of their own. Both incandescent and halogen lamps rely on the heating of a filament by an electric current passing through the filament. In order to produce more light output and a higher color temperature, more current must be provided to the filament and that requires either a larger battery or results in a shorter "burn life". Since divers and explorers are burdened with enough equipment to begin with, a large battery pack is certainly undesirable. Filament lamps also have the disadvantage that the filament is easily damaged by thermal or mechanical shock.

A relatively new type of lamp referred to as a high intensity discharge (HID) lamp is disclosed in U.S. Pat. No. 5,144,201 (the complete disclosure of which is hereby incorporated by reference herein) and is commercially available, for example from Welch Allyn, Inc. (Skaneateles Falls, N.Y.). The HID lamp contains an anode and a cathode and a mixture of mercury, argon and other chemicals. The anode and the cathode are coupled to a ballast having a DC power input. When a DC voltage (typically 9-16 VDC) is applied to the power input of the ballast, the ballast begins a start up sequence. The ballast first produces a series of high voltage (such as 25 KV) high frequency (such as 33 KHZ) pulses that ionize the gases inside the lamp. During this sequence the ballast monitors the resistance of the lamp. When the gases have been sufficiently excited, an arc is struck across the anode and cathode. After the arc is struck, the ballast applies a reduced DC voltage to the anode and cathode of approximately 60 VDC. The ballast continuously monitors the resistance of the lamp and controls the current to the lamp in order to maintain the arc and prevent overdriving, see U.S. Pat. No. 5,381,076 (the complete disclosure of which is hereby incorporated by reference herein). The color of the light produced by the HID lamp is determined by the mix of material (compounds and/or gases) contained in the lamp and the extent to which they are excited by the continuing current. Typically, the desired color temperature is in the range of 4700° K-6500° K.

The HID lamps sold by Welch Allyn and others are not particularly designed for underwater use. Many manufacturers of these lamps intend them to be used in automotive applications and in image projection applications such as projection television. For a variety of reasons, Welch Allyn recommends that the lamp and ballast be located apart from each other. In most applications, this does not present a problem. However, in an underwater lighting system, location of the ballast apart from the lamp can be problematic. The typical underwater lighting system includes a battery pack which is coupled by a cable to a lamp assembly which may be hand held in smaller sizes of lighting systems. If the ballast is not located adjacent to the lamp assembly, it must be located adjacent to the battery pack. The battery pack is typically strapped to the diver's torso, arm or leg. In order for the lamp assembly to be freely positionable, the cable connecting the lamp assembly to the battery pack must be sufficiently long. It has been discovered, however, that if the cable length from the ballast to the lamp assembly is more than approximately 18 inches, the lamp may not reliably start up.

SUMMARY OF THE INVENTION

In accordance with one aspect of the present invention, a high intensity discharge lamp assembly comprises a high intensity discharge lamp having a hermetically sealed glass envelope containing a mixture of ionizable elements and/or compounds and a sealed ballast container including a support base adapted to receive and support the lamp. An electronic ballast within the container has an input and an output. An anode disposed in the envelope is electrically coupled to one pole of the ballast output and a cathode disposed in the envelope is electrically coupled to another pole of the ballast output. Coupling means connect the input of the ballast to a DC power pack, the coupling means comprising wet mateable connectors for switching of DC power packs while underwater. Heat sink means including the ballast container extract heat from the ballast and transfer the extracted heat to an exterior of the ballast container. A waterproof protective cover covers the envelope, is sealed to the support base and has a portion for transmitting light from the lamp.

In accordance with another aspect of the present invention, a high intensity discharge lamp assembly comprises a high intensity discharge lamp having a hermetically sealed glass envelope containing a mixture of ionizable elements and/or compounds and a sealed ballast container mounted adjacent to the glass envelope. An electronic ballast having an input and an output is contained in the container. An anode disposed in the envelope is electrically coupled to one pole of the ballast output and a cathode disposed in the envelope is electrically coupled to another pole of the ballast output. Coupling means connects the input of the ballast to a DC power pack and includes wet mateable connectors for switching DC power packs while underwater. Heat sink means including the ballast container extract heat from the ballast and transfer the extracted heat to an exterior of the ballast container. A waterproof protective cover covers the lamp envelope, is sealingly coupled to the ballast container and has a portion for emission of light outside the lamp assembly.

In accordance with still another aspect of the present invention, a high intensity discharge lamp assembly comprises a high intensity discharge lamp having a hermetically sealed glass envelope containing a mixture of ionizable elements and/or compounds. A sealed ballast container is mounted adjacent to the lamp, is filled with a material and serves as heat sink means. An electronic ballast is contained in the container and has an input and an output with the heat sink means extracting heat from the ballast to an exterior of the ballast container. An anode disposed in the envelope is electrically coupled to one pole of the ballast output and a cathode disposed in the envelope is electrically coupled to another pole of the ballast output. Coupling means couple the input of the ballast to a DC power source and a waterproof protective cover covers the envelope and has a light transmitting portion.

In accordance with an additional aspect of the present invention, an underwater lighting system comprises a high intensity discharge lamp having a hermetically sealed glass envelope containing a mixture of ionizable elements and/or compounds and a sealed ballast container mounted adjacent to the glass envelope. An electronic ballast contained in the ballast container has an input and an output. The ballast container is substantially filled with a thermally conductive material to eliminate vacant spaces withing the container so that the ballast container extracts heat away from the ballast. An anode disposed in the envelope is electrically coupled to one pole of the ballast output and a cathode disposed in the envelope is electrically coupled to another pole of the ballast output. Coupling means couple the input of the ballast to a DC power source. A waterproof protective cover covers the lamp and has a portion for transmitting light from the lamp.

In accordance with yet another aspect of the invention, a lighting system comprises a light head and a power source, the light head including a high intensity discharge lamp having a sealed glass envelope containing a mixture of ionizable elements and/or compounds. A sealed electronics container comprises walls surrounding and enclosing a space and having a support base thereon supporting the lamp. A cover surrounds the lamp, is sealed to the support base and includes a portion allowing light to project outwardly from the light head. An electronic ballast enclosed within the space of the container is in proximity to the lamp to insure reliable ignition. A quantity of thermally conductive material surrounding and in contact with the electronic ballast and also an interior of the walls of the container so that the container extracts heat away from the ballast to the walls of the electronics container.

DETAILED DESCRIPTION

Figure 1:
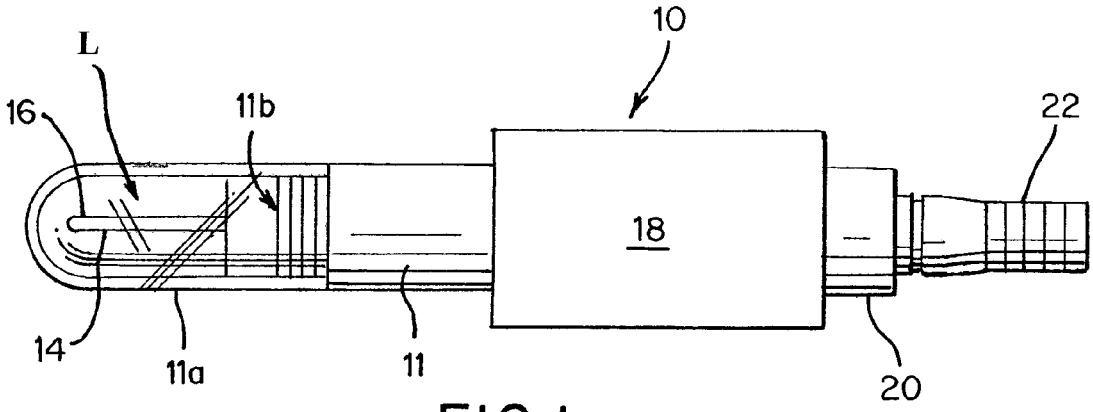
FIG. 1 is a side elevation view of a first embodiment of a lamp and ballast assembly according to the invention.
Figure 1B:
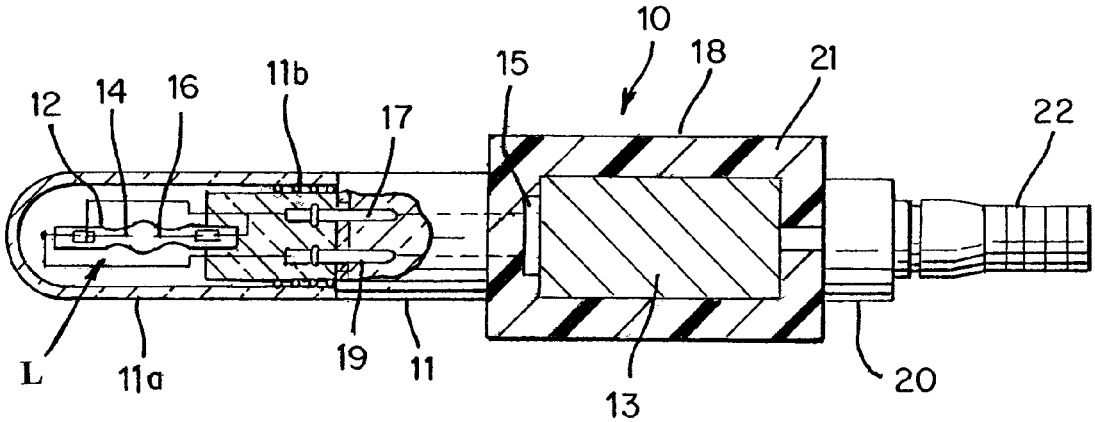
FIG. 1*b* is a schematic representation of the lamp and ballast assembly of FIG. 1*a*.
Figure 1A:
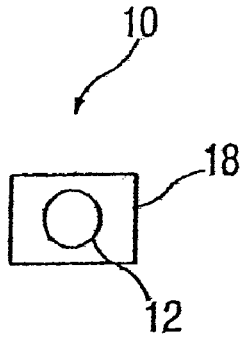
FIG. 1*a* is an end view of the lamp and ballast assembly of FIG. 1.

Turning now to FIGS. 1, 1*a* and 1*b*, a lamp and ballast assembly 10 according to the invention includes a lamp L having an hermetically sealed quartz glass envelope 12 containing an anode 14, a cathode 16, and a mixture of ionizable elements and/or compounds (not shown) such as disclosed in referenced U.S. Pat. No. 5,144,201. A sealed, thermally conductive ballast container 18 located adjacent to the glass envelope 12 of the lamp L includes a lamp support base or lamp support 11 adapted to receive and support the lamp L. As shown in FIG. 1*b*, an electronic ballast 13 (schematically illustrated) having an input 20 and an output 15, is located in the sealed container 18. The output 15 is electrically coupled to the anode 14 and cathode 16 via separate high voltage output poles 17, 19, respectively, through a lamp holder defined by the lamp support 11 which incorporates the high voltage output poles 17, 19. A glass outer tubular waterproof protective cover 11*a* surrounds the quartz glass envelope 12 and extends around the end of the lamp support 11. A portion of the cover 11*a* can serve as a transparent window for transmitting light from the lamp outside the lamp and ballast assembly 10. The waterproof protective cover 11*a* is held in place by O-ring seals 11*b* which also seal the cover 11*a* to the support 11. The ballast container 18, made of metal, plastic or any combination of metal and plastic, is located in close proximity to the quartz envelope 12 of the lamp L and is waterproof and pressure proof so that the ballast container 18 in cooperation with the cover 11*a* provide a waterproof exterior for the lamp and ballast assembly 10.

The container 18 can have mechanically pressure resistant walls, or preferably, is filled and sealed tightly by being filled or potted with a thermally conductive (electrically-non conductive) insulator material. This material, such as an epoxy insulator 21, extends at least from the juncture of the lamp support 11 and the container 18 (see FIG. 1*b*) and fills the interior of the container 18 around the ballast 13 and any related electronics to eliminate vacant spaces within the container 18. This material also serves to extract heat away from the ballast 13 so that the ballast container and the material serve as heat sink means. The ballast container 18 can be in the nature of a mold which, once the potting epoxy has solidified, may optionally be removed. The potted, thermally conductive, electrically non-conductive insulator mass 21 surrounds, or substantially surrounds, the ballast 13 and any related electronic components and extends rearward, e.g., to the right in FIG. 1, from the lamp support 11 and along the ballast input 20.

Figure 10:
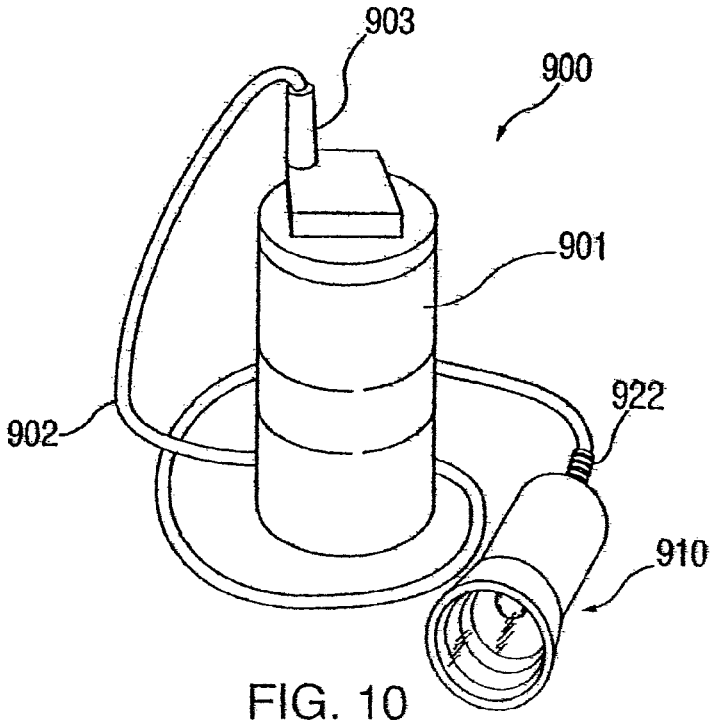
FIG. 10 is a perspective view of a lighting system according to the invention.

The ballast input 20 is preferably coupled to a standard type of connector (see FIG. 7 and FIG. 8 described below) so that the lamp and ballast assembly 10 may be retro-fitted to an existing lighting system or a DC power source 901 via coupling means or cable 902 (see FIG. 10). As shown in FIG. 1, a portion of the connector (otherwise not shown) includes a strain relief 22. As shown in FIGS. 1*a* and 1*b*, the ballast container 18 is rectangular in configuration and surrounds the ballast 13 with a layer of the thermally conductive potting material 21. According to this embodiment, the lamp and ballast assembly 10 is a 10-30 watt lamp, has an overall length of about 8 3/16 inches, and a maximum width of about 2 3/16 inches.

Figure 2A:
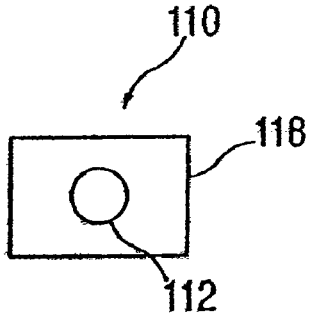
FIG. 2*a* is an end view of the lamp and ballast assembly of FIG. 2.
Figure 2:
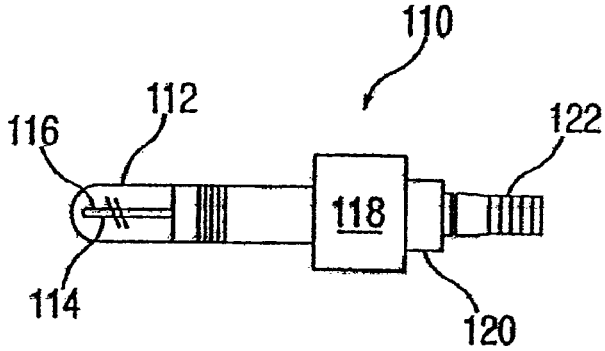
FIG. 2 is a side elevation view of a second embodiment of a lamp and ballast assembly according to the invention.

Turning now to FIGS. 2 and 2*a*, a lamp and ballast assembly 110 according to the invention is similar to the lamp and ballast assembly 10 described above with similar reference numerals referring to similar features. According to this embodiment, the lamp and ballast assembly 110 includes a 10-30 watt lamp, has an overall length of about 6 1/16 inches and a maximum width of about 3 3/16 inches.

Figure 3A:
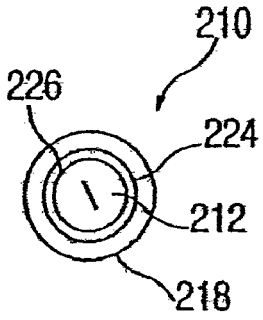
FIG. 3*a* is an end view of the lamp and ballast assembly of FIG. 3.
Figure 3:
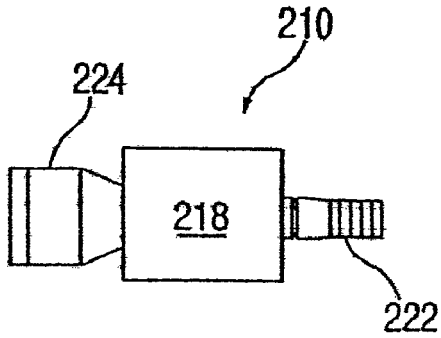
FIG. 3 is a side elevation view of a third embodiment of a lamp and ballast assembly according to the invention.

Turning now to FIGS. 3 and 3*a*, a lamp and ballast assembly 210 according to the invention is similar to the lamp and ballast assembly 10 described above with similar reference numerals referring to similar features. According to this embodiment, the glass envelope 212 is contained within a cylindrical protector 224 having a transparent or otherwise light transmitting portion illustrated as a window 226 and the ballast container 218 is also cylindrical. The lamp and ballast assembly 210 includes a 10-30 watt lamp, has an overall length of about 5 inches and a maximum diameter of about 2 3/8 inches.

Figure 4A:
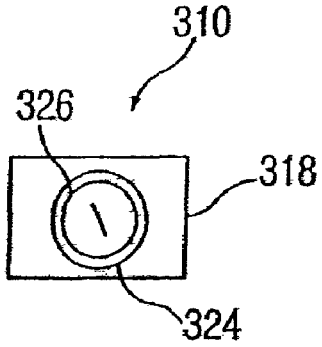
FIG. 4*a* is an end view of the lamp and ballast assembly of FIG. 4.
Figure 4:
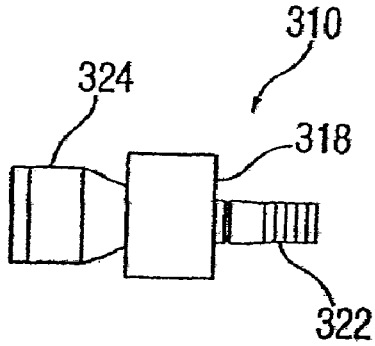
FIG. 4 is a side elevation view of a fourth embodiment of a lamp and ballast assembly according to the invention.

Turning now to FIGS. 4 and 4*a*, a lamp and ballast assembly 310 according to the invention is similar to the lamp and ballast assembly 210 described above with similar reference numerals referring to similar features. According to this embodiment, the ballast container 318 is rectangular. The lamp and ballast assembly 310 includes a 10-30 watt lamp, has an overall length of about 5 inches and a maximum width of about 3 3/16 inches.

Figure 5A:
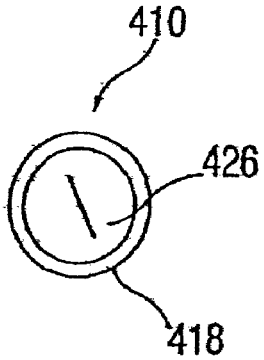
FIG. 5*a* is an end view of the lamp and ballast assembly of FIG. 5.
Figure 5:
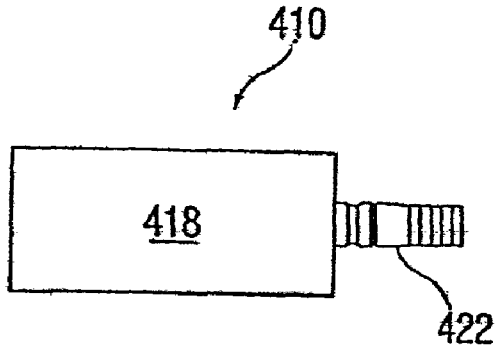
FIG. 5 is a side elevation view of a fifth embodiment of a lamp and ballast assembly according to the invention.

FIGS. 5 and 5*a* illustrate a lamp and ballast assembly 410 which is housed in a monolithic cylinder 418 having a transparent window 426 at one end and a strain reliever 422 at its opposite end. The lamp and ballast assembly 410 includes a 10-30 watt lamp, has an overall length of about 5 5/18 inches and a maximum diameter of about 2½ inches. The monolithic cylinder is preferably hermetically sealed and waterproof to a predetermined depth.

Figure 6A:
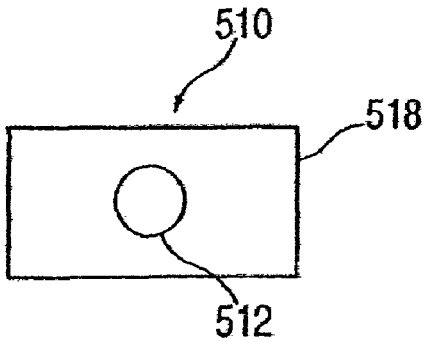
FIG. 6*a* is an end view of the lamp and ballast assembly of FIG. 6.
Figure 6:
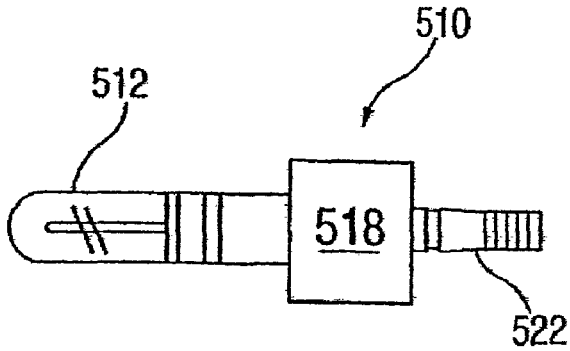
FIG. 6 is a side elevation view of a sixth embodiment of a lamp and ballast assembly according to the invention.

FIGS. 6 and 6*a* illustrate a lamp and ballast assembly 510 which is similar to the lamp and ballast assemblies 10 and 110 described above. The lamp and ballast assembly 510 includes a 50-90 watt lamp, has an overall length of about 7.25 inches and a maximum width of about 5.187 inches.

Figure 7:
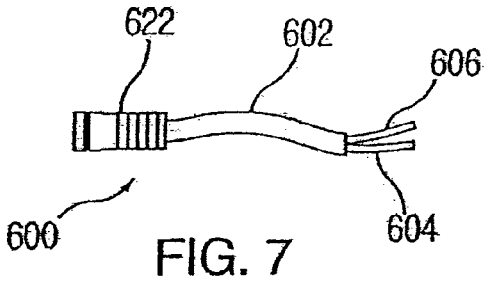
FIG. 7 is a side elevation view of a first embodiment of a cable connector.

Turning now to FIG. 7, a connector 600 according to the invention includes a cable 602 having free ends 604, 606 for relatively permanent coupling to a battery pack (not shown). The other end of the connector 600 has a strain relief 622 which is similar to the strain reliefs describe above.

Figure 8:
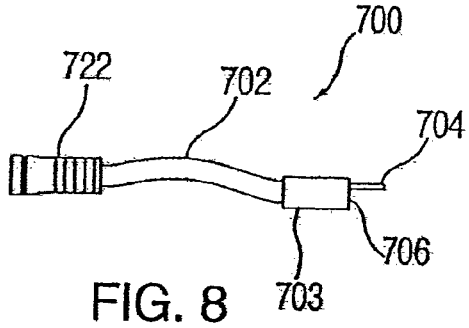
FIG. 8 is a side elevation view of a second embodiment of a cable connector.

FIG. 8 illustrates an alternate connector 700, which includes a cable 702 having a male/female connector 703 with a male contact 704 and a female contact 706 at one end thereof and a strain relief 722 at the other end thereof. The connector 700 is designed to be temporarily connected to a battery pack and swappable to another battery pack while under water ("wet pluggable" or "wet mateable") using a mating connector from the battery/power pack (not shown).

Figure 9:
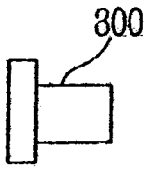
FIG. 9 is a side elevation view of a socket for use with the cable connector of FIG. 8.
Figure 9A:
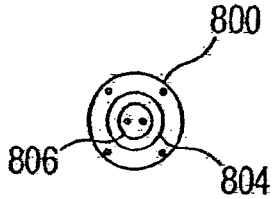
FIG. 9*a* is an end view of the socket of FIG. 9.

FIGS. 9 & 9A illustrate an alternate connection 800 which includes a male contact 804 and a female contact 806. The connector 800 is designed to be temporarily connected to a battery pack and swappable to another battery pack while under water ("wet pluggable" or "wetmateable") using a mating connector from the battery/power pack.

FIG. 10 illustrates a lighting system 900 according to the invention. The system 900 includes a battery pack 901 and a lamp and ballast assembly 910. The ballast in the lamp and ballast assembly 910 is coupled by a cable 902, having a connector 903 and a strain relief 922, to the battery pack 901. The assembly 910 is hermetically sealed and waterproof to a predetermined depth.

Figure 11A:
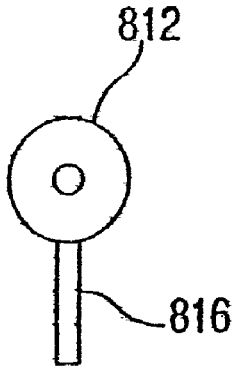
FIG. 11*a* is an end view of the invention shown in FIG. 11.
Figure 11:
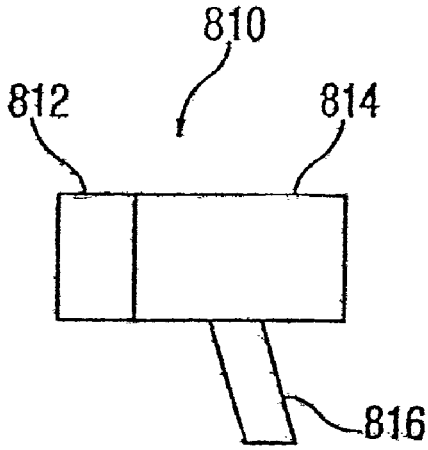
FIG. 11 is a side elevation view of a seventh embodiment of the invention showing a hand-held unit composed of a lamp ballast and battery.

FIGS. 11 and 11*a* illustrate a hand-held lamp and ballast assembly 810 which is similar to lamp and ballast assemblies 10, 110, 510 described above. The lamp and ballast assembly 810 is composed of a 10-20 Watt HID lamp and reflector assembly 812 which is coupled to a ballast and battery pack contained in housing 814 which is provided with a handle grip 816. The assembly has an overall length of 5" to 12" and a width or diameter from 2" to 6". Both dimensions will be dependent on the battery chemistry and size used.

Figure 12A:
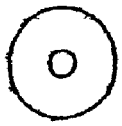
FIG. 12*a* is an end view of the unit shown in FIG. 12.
Figure 12:
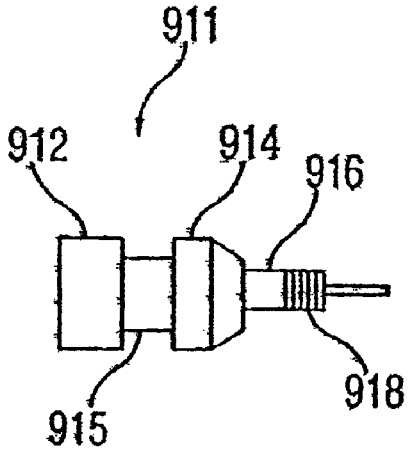
FIG. 12 is a side elevation view of an eighth embodiment of the invention in the form of a head-mount or hand-held unit composed of a lamp and ballast.

FIGS. 12 and 12*a* illustrate a mini lamp and ballast assembly 911 which is similar to lamp and ballast assemblies 10, 110, and 510 described above. The lamp and ballast assembly 911 is composed of a 10-20 watt HID lamp and reflector assembly 912 which is coupled to a ballast contained in ballast housing 914 which, in turn, is provided with a connector 916 and a strain relief 918 to permit coupling to a remote battery pack (not shown). The lamp and ballast assembly 911 has an overall length of about 3¼". The lamp and ballast assembly 911 is provided with a recessed center section 915 to allow the same to be releasably attached to a head clamp (not shown). Alternatively, it could be hand held.

There have been described and illustrated herein several embodiments of a high intensity discharge (HID) lamp with integral ballast used in underwater lighting systems incorporating the same. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A high intensity discharge lamp assembly comprising:

a high intensity discharge lamp comprising a hermetically sealed glass envelope containing a mixture of ionizable elements and/or compounds;

a sealed ballast container including a support base adapted to receive and support said lamp;

an electronic ballast within said container, said ballast having an input and an output;

an anode disposed in said envelope and electrically coupled to one pole of said ballast output;

a cathode disposed in said envelope and electrically coupled to another pole of said ballast output;

coupling means for connecting said input of said ballast to a DC power pack, said coupling means comprising wet mateable connectors for switching of DC power packs while underwater;

heat sink means including said ballast container for extracting heat from said ballast and transferring said extracted heat to an exterior of said ballast container; and a waterproof protective cover covering said envelope and sealed to said support base, said waterproof protective cover having a portion for transmitting light from said lamp.

2. A high intensity discharge lamp assembly comprising:

a high intensity discharge lamp comprising a hermetically sealed glass envelope containing a mixture of ionizable elements and/or compounds;

a sealed ballast container mounted adjacent to said glass envelope;

an electronic ballast contained in said container, said ballast having an input and an output;

an anode disposed in said envelope and electrically coupled to one pole of said ballast output;

a cathode disposed in said envelope and electrically coupled to another pole of said ballast output;

coupling means for connecting said input of said ballast to a DC power pack, said coupling means comprising wet mateable connectors for switching of DC power packs while underwater;

heat sink means including said ballast container for extracting heat from said ballast and transferring said extracted heat to an exterior of said ballast container; and a waterproof protective cover covering said lamp envelope and sealingly coupled to said ballast container, said waterproof protective cover having a portion for emission of light outside said lamp assembly.

3. A high intensity discharge lamp assembly comprising:

a high intensity discharge lamp comprising a hermetically sealed glass envelope containing a mixture of ionizable elements and/or compounds;

a sealed ballast container mounted adjacent to said lamp, said ballast container being filled with a material and serving as heat sink means;

an electronic ballast contained in said container, said ballast having an input and an output, said heat sink means extracting heat from said ballast to an exterior of said ballast container;

an anode disposed in said envelope and electrically coupled to one pole of said ballast output;

a cathode disposed in said envelope and electrically coupled to another pole of said ballast output;

coupling means for coupling said input of said ballast to a DC power source; and a waterproof protective cover covering said envelope and having a light transmitting portion.

4. A lamp assembly according to claim 1 wherein said ballast container is made from metal, plastic or any combination thereof.

5. A lamp assembly according to claim 2 wherein said ballast container is made from metal, plastic or any combination thereof.

6. A lamp assembly according to claim 3 wherein said ballast container is made from metal, plastic or any combination thereof.

7. An underwater lighting system comprising:

a high intensity discharge lamp comprising a hermetically sealed glass envelope containing a mixture of ionizable elements and/or compounds;

a sealed ballast container mounted adjacent to said glass envelope;

an electronic ballast contained in said ballast container, said ballast having an input and an output and said ballast container being substantially filled with a thermally conductive material to eliminate vacant spaces therein;

an anode disposed in said envelope and electrically coupled to one pole of said ballast output;

a cathode disposed in said envelope and electrically coupled to another pole of said ballast output;

coupling means for coupling said input of said ballast to a DC power source; and a waterproof protective cover covering said lamp, said waterproof protective cover having a portion for transmitting light from said lamp;

wherein said ballast container extracts heat away from said ballast.

8. An underwater lighting system according to claim 7 wherein said coupling means comprises a cable and wherein said cable and said DC power source each includes a wet mateable connector.

9. An underwater lighting system according to claim 7 wherein said coupling means comprises a cable which is permanently connected to a power output of said DC power source.

10. An underwater lighting system according to claim 7 wherein said ballast container is made from metal, plastic or any combination thereof.

11. An underwater lighting system according to claim 7 wherein said ballast is mounted within 18 inches of said lamp.

12. An underwater lighting system according to claim 7 wherein said DC power supply comprises a battery pack.

13. A lighting system comprising:

a light head and a power source, said light head including a high intensity discharge lamp having a sealed glass envelope containing a mixture of ionizable elements and/or compounds;

a sealed electronics container comprising walls surrounding and enclosing a space and having a support base thereon supporting said lamp;

a cover surrounding said lamp and sealed to said support base, said cover including a portion allowing light to project outwardly from said light head;

an electronic ballast enclosed within said space of said container, said ballast being in proximity to said lamp to insure reliable ignition; and a quantity of thermally conductive material surrounding and in contact with said electronic ballast and also an interior of said walls of said container so that the container extracts heat away from said ballast to the walls of said electronics container.

14. A lighting system according to claim 13 wherein said electronics container is waterproof and pressure proof.

15. A lighting system according to claim 13 wherein said thermally conductive material fills said space to eliminate vacancies within said space.

16. A lighting system according to claim 13 wherein said light head is a scuba light.

17. A lighting system according to claim 13 wherein said light head is ergonomically designed to be comfortable during use.

18. A lighting system according to claim 13 wherein said light head and said power source are modular.

* * * * *